US010053816B2

(12) United States Patent
Li et al.

(10) Patent No.: US 10,053,816 B2
(45) Date of Patent: Aug. 21, 2018

(54) METHOD FOR CONTINUOUSLY COOKING GRASS RAW MATERIALS AND DEVICE

(71) Applicant: Shandong Tralin Paper Co., Ltd., Shandong (CN)

(72) Inventors: Hongfa Li, Shandong (CN); Mingxin Song, Shandong (CN); Songtao Chen, Shandong (CN); Qingtao Wang, Shandong (CN); Jixing Chu, Shandong (CN); Yingwen Dong, Shandong (CN)

(73) Assignee: SHANDONG TRALIN PAPER CO., LTD., Liaocheng (CN)

( * ) Notice: Subject to any disclaimer, the term of this patent is extended or adjusted under 35 U.S.C. 154(b) by 0 days.

(21) Appl. No.: 15/445,265

(22) Filed: Feb. 28, 2017

(65) Prior Publication Data

US 2017/0268168 A1 Sep. 21, 2017

(30) Foreign Application Priority Data

Feb. 29, 2016 (CN) ..... 2016 1 0111833

(51) Int. Cl.

| | |
|---|---|
| ***D21C 3/24*** | (2006.01) |
| ***D21H 11/12*** | (2006.01) |
| ***D21C 1/02*** | (2006.01) |
| ***D21C 3/02*** | (2006.01) |
| ***D21C 3/26*** | (2006.01) |

(52) U.S. Cl.

CPC ..... *D21C 3/24* (2013.01); *D21C 1/02* (2013.01); *D21C 3/024* (2013.01); *D21C 3/26* (2013.01); *D21H 11/12* (2013.01)

(58) Field of Classification Search

USPC ..... 162/19, 233

See application file for complete search history.

(56) References Cited

U.S. PATENT DOCUMENTS 3,097,987 A * 7/1963 Sloman ..... D21C 3/24 162/17
3,684,651 A * 8/1972 Reinhall ..... D21C 1/00 162/19

(Continued)

FOREIGN PATENT DOCUMENTS

CN 101906729 A 12/2010
CN 101906730 A 12/2010

(Continued)

*Primary Examiner* — Mark Halpern
(74) *Attorney, Agent, or Firm* — Buchanan Ingersoll & Rooney PC

(57) ABSTRACT

A method for continuously cooking grass raw materials, includes: (1) preparing grass raw materials by conventional dry or wet method to obtain a chopped grass; (2a) conveying the chopped grass into a T-shaped tube, adding a cooking liquor from a top of the tube and mixing with the chopped grass tube to obtain a forage; (2b) adding steam to the forage being in the horizontal tube, the forage being heated and going into a spherical mixer; (2c) adding a cooking liquor extruded by a dehydration spiral into the spherical mixer, mixing uniformly with the forage in the spherical mixer; (3) conveying the forage after the pre-cooking process to a digester, heating the cooking liquor by a heater arranged outside the digester, and sending the cooking liquor back to the digester for cooking the forage to obtain a pulp of the grass raw materials.

14 Claims, 2 Drawing Sheets

(56) References Cited

U.S. PATENT DOCUMENTS

| | | | | | |
|---|---|---|---|---|---|
| 4,338,158 | A * | 7/1982 | Bentvelzen | D21C 9/1036 162/37 |
| 6,106,668 | A * | 8/2000 | Stromberg | D21C 7/06 162/52 |
| 6,325,888 | B1 * | 12/2001 | Miele | D21C 1/02 162/17 |
| 6,325,890 | B1 * | 12/2001 | Prough | D21C 1/10 162/52 |
| 2012/0067533 | A1 | 3/2012 | Kurosu et al. | |
| 2017/0107665 | A1 * | 4/2017 | Mikulic | D21C 3/24 |
| 2018/0044854 | A1 * | 2/2018 | Li | D21C 7/02 |

FOREIGN PATENT DOCUMENTS

| | | | | |
|---|---|---|---|---|
| CN | 1022514125 | A | 11/2011 | |
| CN | 102677505 | A | 9/2012 | |
| GB | 686250 | * | 1/1953 | |
| GB | 770687 | * | 3/1957 | |
| GB | 892277 | * | 3/1962 | |
| GB | 347096 | * | 4/1981 | |
| GB | 2265918 | * | 10/1993 | |
| WO | WO 2015/150841 | * | 10/2015 | D21C 3/02 |

* cited by examiner

METHOD FOR CONTINUOUSLY COOKING GRASS RAW MATERIALS AND DEVICE

This application claims priority to Chinese Patent Application No. 201610111833.4, filed Feb. 29, 2016 in the State intellectual Property Office of P.R. China, the disclosures of which are incorporated by reference in their entirety herein.

FIELD OF THE INVENTION

The present invention refers to the field of papermaking pulp, more particularly, relates to a method for continuously cooking grass raw materials and device thereof.

BACKGROUND OF THE INVENTION

Substantially, plant fiber raw materials for papermaking include: wood fiber and grassy fiber.

The parenchyma cell in the grass fiber is high content, and interlaces poorly with the fiber. For the pulp manufactured by an existing process, it is not easily bleached, so that there is minimum value of pulp and paper making. The drain ability of rice straw pulp is poor, the strength of the paper is poor, the value of the crack length is low, the tear value is low, and the folding degree is less. So far all over the world within the scope of papermaking is the most widely used wood fiber, grass fiber with less, but with the lack of forest resources greatly, how to use straw raw material chemical pulp to produce high quality is a serious problem facing now.

The existing methods for manufacturing pulp with grass plants contain: chemical method, mechanical method, chemical and mechanical method. For the chemical method for manufacturing pulp, some components of grass fiber raw material are removed to cause the raw materials dissociation into pulp by means of chemical action in the cooking step. The cooking methods in the chemical method can be subdivided into lime method, soda method, caustic soda anthraquinone method, sulfate method, sulfite method and the like.

In the prior art, it's usually considered that grass pulp need to keep cooking and stay warm for longer time for making pulp more "soft" in order to achieve chemical pulp with high whiteness. For example, the article which is entitled "Assumption and preliminary practice for strengthening the preparation of grasses and improvement of cooking" in Hubei Institute of Technology, 1999, 14(3) mentions that the hardness of pulp K value is below 10, well up to 7-8, the pulp yield reaches more than 50%, well up to 57%, and the breaking length is more than 4000 m, well up to 7000 m above, as a result, the grass pulp has advantages such as with deep delignification, lighter color, being bleached easily, good strength, high yield in cooking. However, the pulp with high hardness, especially $KMnO_4$ value 16-22, equivalent to kappa value 23-36, is used to produce high strength unbleached pulp and bleached pulp with whiteness of 60-70% ISO, thus can reduce energy consumption and improve the yield.

The production efficiency of continuous pulping is high. For non wood fiber, in the method for manufacturing pulp, horizontal tube continuous cooking system is selected firstly. At present, it is widely used at home and abroad in that the method is mature, convenient in control, compact in structure and short in cooking time.

Chinese patent application Publication No. CN101906729A discloses a method for continuously cooking grass raw materials, comprises the following steps: (1) preparing the grass raw materials before dipping to obtain the grass raw materials after preparing and before dipping; (2) conveying the prepared fibrous raw materials into an impregnator through a screw feeder, and adding impregnation liquid for dipping treatment, putting the prepared grass raw materials and the impregnation liquid in a digester to the digester at the same time, and then adding hot black liquor for primary cooking to obtain the primarily cooked grass raw materials; (3) adding cooking liquor to the primarily cooked grass raw materials for secondary cooking to obtain pulp of the grass raw materials. The method of the invention achieves the purpose of continuously cooking the grass raw materials with large liquor ratio, shortens cooking time, reduces energy consumption and improves uniformity of the pulp. The invention further provides cooking device used in the method.

Although this method realizes to continuously cook grass raw materials in large liquid ratio, shorten the cooking time, reduce the energy consumption and improve the uniformity of the slurry, due to the use of vertical continuous digester, the scale of production will lead to a large area of plant, resulting in higher device investment.

In view of foregoing, the invention is proposed.

SUMMARY OF THE INVENTION

An object of the invention is to overcome the defects, and provides a method for continuously cooking grass raw materials and device which has the advantages of small floor area, low device investment, and large capacity.

One aspect of the invention relates to a method for continuously cooking grass raw materials comprising the following steps:

1. Preparing material:

Preparing grass raw materials by a conventional dry or wet method to obtain a chopped grass;

2. Pre-cooking:

(1) Conveying the chopped grass into a T-shaped tube after being extruded by a screw feeder, adding cooking liquor from a top of the T-shaped tube and steam, and mixing with the chopped grass in T-shaped tube to obtain forage;

(2) Adding steam from a bottom of a horizontal tube after the forage being into the horizontal tube, the forage being heated and going into a spherical mixer;

(3) Adding the cooking liquor extruded by a dehydration spiral into the spherical mixer, mixing uniformly with the forage in the spherical mixer, thus completes pre-cooking;

3. Cooking:

Conveying the forage after pre-cooking to a digester, heating the cooking liquor by a heater arranged outside the digester, and sending the cooking liquor heated hack to the digester for cooking the forage to obtain a pulp of the grass raw materials.

A second aspect of the invention provides a device for continuously cooking grass raw materials.

The device includes a T-shaped tube, a horizontal tube and a digester, a spherical mixer arranged between the horizontal tube and the digester; one end of the horizontal tube connected with the spherical mixer, and other end connected with the T-shaped tube.

Compared with the prior art, the invention has the following advantages:

The method for continuously cooking grass raw materials in the present invention is provided, the horizontal tube is combined with the vertical tube to continuously cook, which can maximize their advantages respectively. As a result, not only the quality, the evenness and bleaching performance of the pulp can be improved, but also the black liquor can be reused. Due the black liquor with low viscosity, the black liquor is recovered easily. Particularly the method has low energy consumption, reduces emissions. Therefore, it is benefit to environmental protection. In addition, the device for continuously cooking grass raw materials has the advantages of large capacity, compact structure, reasonable layout, small floor area, and so on.

BRIEF OF DESCRIPTION OF THE DRAWINGS

Figure 1:
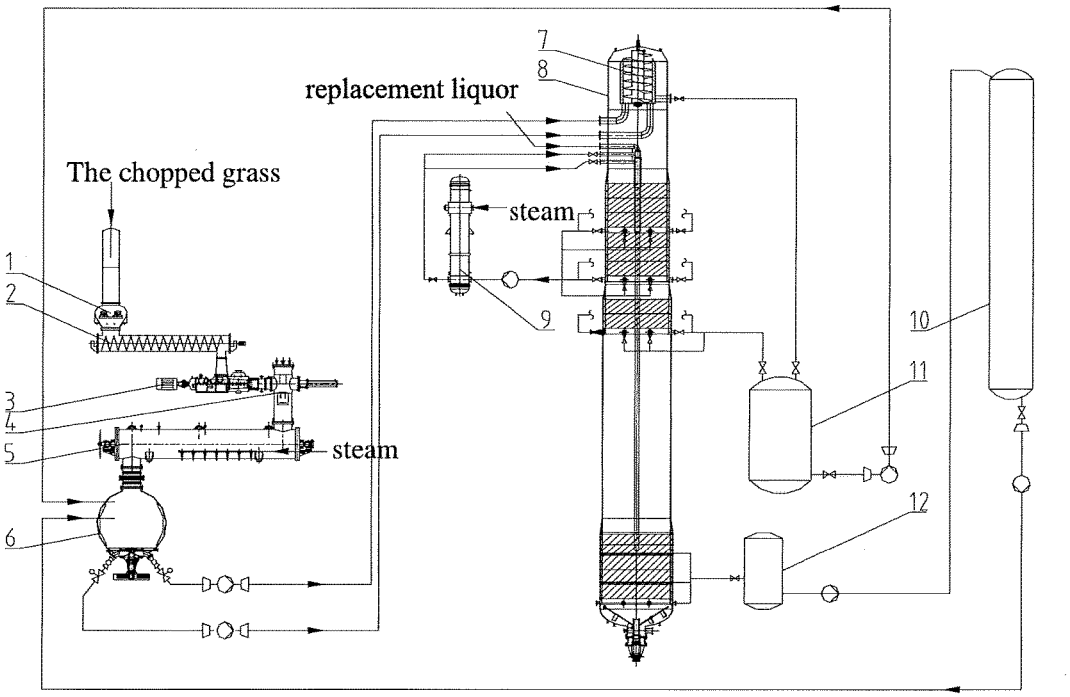
FIG. 1 is a structure schematic view of a device for continuous cooking in the present invention.
Figure 2:
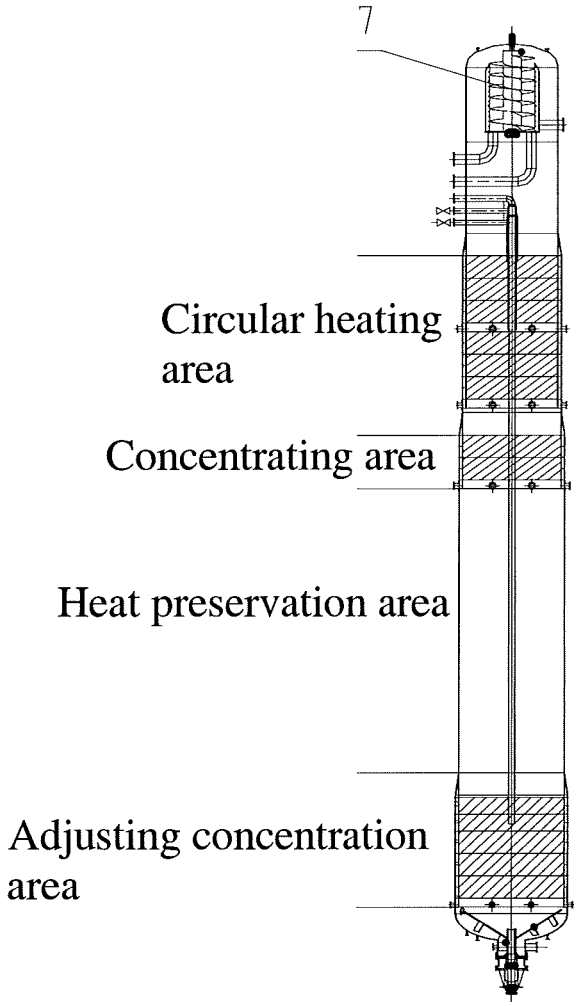
FIG. 2 is a structure schematic view of a digester in the present invention.

| | |
|---|---|
| 1—Pin drum metering device, | 2—Pre-cooking spiral, |
| 3—Screw feeder, | 4—T-shaped tube, |
| 5—Horizontal tube, | 6—Spherical mixer, |
| 7—Dehydration spiral, | 8—Digester, |
| 9—Heater, | 10—Hot black liquor tank, |
| 11—Buffer tank | 12—Concentrating tank. |

DETAILED DESCRIPTION OF THE INVENTION

The present invention is described in detail below.

A method for continuously cooking grass raw materials comprises the following steps:

1. Preparing material:

Preparing grass raw materials by a conventional dry or wet method to obtain a chopped grass;

2. Pre-cooking:

(1) Conveying the chopped grass into a T-shaped tube after being extruded by a screw feeder, adding cooking liquor from a top of the T-shaped tube and steam, and mixing with the chopped grass in T-shaped tube to obtain forage;

(2) Adding steam from a bottom of a horizontal tube after the forage being into the horizontal tube, the forage being heated and going into a spherical mixer;

(3) Adding the cooking liquor extruded by a dehydration spiral into the spherical mixer, mixing uniformly with the forage in the spherical mixer, thus completes pre-cooking;

3. Cooking:

Conveying the forage after pre-cooking to a digester, heating the cooking liquor by a heater arranged outside the digester, and sending the cooking liquor heated back to the digester for cooking the forage to obtain a pulp of the grass raw materials.

Specifically, a cooking process comprises:

conveying the forage after pre-cooking to the digester, pumping the cooking liquor from the digester by a circulating pump and adjusting a liquid ratio to a range from 1:7 to 1:10, heating the cooking liquor pumped from the digester by the heater arranged outside the digester, sending the cooking liquor after heating back to the digester to heat the forage to a temperature from 150° C. to 175° C., and keeping the temperature for 40-120 minutes, and obtaining the pulp of the grass raw materials.

The cooking process comprises four stages: circular heating stage, concentrating stage, heat preservation stage and adjusting concentration stage.

in the circularly heating stage, the cooking liquor is pumped from the digester by the circulating pump and adjusting the liquid ratio to the range from 1:7 to 1:10, and the cooking liquor pumped is heated by the heater arranged outside the digester and sent back to the digester for heating the forage to a temperature from 150° C. to 175° C.;

In the concentrating stage, the liquid ratio is adjusted to a range from 1:5 to 1:6 by pumping out some cooking liquor.

In one embodiment, in step (1) of the pre-cooking process, a amount of the cooking liquor in the T-shaped tube is in a range from 20% to 26% of the weight of hone dry grass raw materials in an ammonium cooking method, or is in a range from 10% to 16% in a sodium hydroxide cooking method. The liquid ratio is in a range from 1:2.8 to 1:3.3.

The temperature of the cooking liquor is at room temperature or heated to less than 95° he, and the temperature of the forage in T-shaped tube is in a range from 85° C. to 95° C. after the cooking liquor is mixed with the chopped grass in the T-shaped tube.

In step (2) of the pre-cooking process, the forage is heated up to a temperature from 130° C. to 150° C., and a duration time of the forage in the horizontal tube is in a range from 5 min to 12 min.

In step (3) of the pre-cooking process, the cooking liquor with the temperature between 145° C. and 155° C. is extruded by the dehydration spiral, is mixed with the forage. A mixing concentration is in a range from 3% to 5%, and a temperature is in a range from 145° C. is to 155° C. to after mixing. A duration time in the spherical mixer is in a range from 1.5 min to 3 min.

In step (1) of the pro-cooking process, before being conveyed into the T-shaped tube, the chopped grass is measured by a pin drum metering device and enters into a pre-cooking spiral. Steam is added into the pre-cooking spiral to soften the chopped grass, in which a temperature is controlled in a range from 40° C. to 60° C. Then the chopped grass enters into the T-shaped tube after being extruded by the screw feeder. A moisture of the chopped grass into the T-shaped tube is in a range from 55% to 65%, and a temperature is in a range from 70° C. to 80° C.

In the cooking process, the forage after proceeding to the pre-cooking process is conveyed to the digester. First, a dehydration processing is done by the dehydration spiral disposed on the top of the digester until a dry degree in a range from 10% to 12%. And a pressure of the digester top is controlled in the range from 5 to 8 bar.

More specifically, the cooking process includes the following steps:

(1) Conveying the forage after proceeding to the pre-cooking to the dehydration spiral which is arranged on the top of the digester by a pump for grass piece for a dehydrating treatment, dehydrating until the dry degree in the range from 10% to 12%; the extruded cooking liquor flowing back into a buffer tank and pumping to the spherical mixer by a pump as part of the cooking liquor.

(2) A dehydrated forage entering to a circular heating area of the digester, pumping out the cooking liquor from the digester by the circulating pump to adjust the liquid ratio to the range from 1:7 to 1:10, the cooking liquor pumped being heated by heater arranged outside the digester and sent back to the digester for heating the forage in the circular heating area to a temperature in a range from 150° C. to 175° C.; and then entering into a concentrating area, adjusting the liquid ratio to the range from 1:5.5 to 1:6.5 by pumping out some of the cooking liquor, and the cooking liquor pumped flowing back into the buffer tank, and pumping to the spherical mixer by a pump as part of the cooking liquor, and then entering into a heat preservation area, keeping the temperature between 150° C. and 175° C. for 40-120 minutes, finally obtaining a coarse pulp and black liquor;

(3) The coarse pulp and black liquor entering to an adjusting concentration area. The black liquor is filtered through a filter screen arranged in the adjusting concentration area, and enters into a concentration tank. Then the black liquor is pumped to a hot black liquor tank by a concentrated pump and enters to the spherical mixer as supplementary black liquor which is used for the cooking liquor together with the cooking liquor in the spherical mixer pumped from a buffer tank. The black liquor with lower temperature enters the digester from an intermediate pipe of the digester as a replacement liquid, mixes with the come pulp for replacement and concentration adjustment. The coarse pulp is adjusted to a concentration of 6~8% and a temperature of 90~100° C. in this area, and then proceeds cold blow through a discharger at the bottom of the digester. A pulp of the grass raw materials is obtained, at the same time a heavy black liquor replaced is recycled.

In the present invention, the temperature of the black liquor as the replacement liquid is in a range from 45° C. to 65° C., preferably, the temperature of the black liquor in a extraction section is in a range from 45° C. to 65° C.

In one embodiment, the concentration of the pulp from the digester is in a range from 6% to 8%, and the temperature is between 90° C. and 100° C.

The pulp of the grass raw materials has a hardness of potassium permanganate 20-26 k.

The grass raw materials is one or more than one selected from rice straw, wheat straw, reed, bamboo reed, corn stalk and cotton stalk.

The present invention also provides a device for continuously cooking grass raw materials.

The device includes a T-shaped tube, a horizontal tube and a digester, a first end of the horizontal tube connected with the T-shaped tube, and a second end connected with the spherical mixer, a spherical mixer connected with the digester through a straw piece pump;

The digester comprises a circular heating area, a concentrating area, a heat preservation area and an adjusting concentration area, and a dehydration spiral arranged on a lop of the digester.

In the present invention, due to the concentrating area in digester the liquid ratio can be reduced, thereby a height of the digester is reduced.

A filter screen is arranged in the circular heating area, in the concentrating area and in the adjusting concentration area respectively.

The spherical mixer is connected with the digester by a pump for grass piece.

In one embodiment, the T-shaped tube is connected in turn with a screw feeder, a pre-cooking spiral and a pin drum metering device.

In one embodiment, an upper part and a middle part of the digester are connected with a buffer tank respectively, and a lower part of the digester is connected with a concentrating tank.

In one embodiment, the buffer tank is connected with the spherical mixer.

The buffer tank is connected with the spherical mixer through a pump.

In one embodiment, a hot black liquor tank is connected with the spherical mixer and the T-shaped tube.

Specific embodiments of the present invention are further described below in detail with reference to the accompanying drawings, but it is to be understood that the invention is not limited to the details process step set forth in the following description.

Embodiment 1

1) Preparing material:

The grass raw materials were processed by conventional dry or wet method to obtain a chopped grass;

2) Pre-cooking:

(1) The chopped grass was conveyed into a T-shaped tube after being extruded by a screw feeder, the cooking liquor was added from a top of the T-shaped tube and steam, and mixed with the chopped grass in the T-shaped tube to obtain forage;

(2) The forage entered into a horizontal tube, and steam flowed in the horizontal tube from a bottom of the horizontal tube to heat the forage, then the forage entered into a spherical mixer;

(3) The cooking liquor which was extruded by a dehydration spiral was added to the spherical mixer, and mixed uniformly with the forage in the spherical mixer in a concentration of 3~5% to complete pre-cooking;

3) Cooking:

The forage after pre-cooking process was conveyed to a digester for cooking, and the pulp of the grass raw materials was obtained.

Embodiment 2

1) Preparing material:

The wheat straw materials were processed by conventional dry or wet method to obtain a chopped wheat straw.

2) Pre-cooking:

(1) The chopped wheat straw was conveyed into a T-shaped tube after being extruded by a screw feeder, the ammonium sulfite cooking liquor with a room temperature, a hot black liquor and steam were added from a top of T-shaped tube and mixed with the chopped grass in the T-shaped tube to obtain a forage with a temperature of 85° C. Wherein the amount of the cooking liquor was 20% of the weight of hone dry grass raw materials, and the liquid ratio was 1:2.8.

(2) The forage entered into a horizontal tube, and steam flows in the horizontal tube from the bottom to heat the forage up to 145° C. up and keep in the horizontal tube for 5 minutes, and then the forage entered into the spherical mixer.

(3) The cooking liquor at 145° C. which was extruded by a dehydration spiral and the hot black liquor at 160° C. were added into the spherical mixer, mixed uniformly with the forage in the spherical mixer. The mixed concentration was 3%, the mixed temperature was 155° C. The mixture stayed in the spherical mixer for 1.5 minutes to complete pre-cooking.

3) Cooking:

The forage after the pre-cooking process was conveyed to a digester. Firstly, the forage was dehydrated in the dehydration spiral which is arranged on the top of the digester to a dry degree of 10%. The cooking liquor was pumped out from the digester by a circulating pump, and the liquid ratio was adjusted to 1:7. The pumped cooking liquor was heated by a heater outside the digester and was transported back into the digester for heating the forage up to 172° C., and keeping the temperature for 80 minutes. The pulp of the wheat straw materials is obtained.

Embodiment 3

1) Preparing material:

The rice straw materials were processed by conventional dry or wet method to obtain a chopped grass.

2) Pre-cooking:

(1) The a chopped rice straw with a temperature of 95° C., was conveyed into a T-shaped tube after being extruded by a screw feeder, and the ammonium sulfite cooking liquor with a room temperature, a hot black liquor and steam were added from a top of the T-shaped tube and mixed with the chopped rice straw in the T-shaped tube to obtain a forage with a temperature of 95° 5. Wherein the amount of the cooking liquor was 26% of the weight of hone dry grass raw materials, the liquid ratio was 1:3.3.

(2) The forage entered into a horizontal tube, and steam flows in the horizontal tube for the bottom to heat the forage up to 150° C. and keep in the horizontal tube for 7 minutes, and then the forage entered into the spherical mixer.

(3) The cooking liquor at 155° C. which was extruded by a dehydration spiral and the hot black liquor at 165° C. were added into the spherical mixer, mixed uniformly with the forage in the spherical mixer. The mixed concentration was 5%, and the mixed temperature was 160° C. The mixture stayed in the spherical mixer for 3 minutes to complete pre-cooking.

3) Cooking:

The forage after the pre-cooking process was conveyed to a digester. Firstly, the forage was dehydrated in the dehydration spiral which is arranged on the top of the digester to a dry degree of 12%. The cooking liquor was pumped out from the digester by the circulating pump, and the liquid ratio was adjusted to 1:10. The pumped cooking liquor was heated by a heater outside the digester and was transported back into the digester for heating the forage up to 165° C. and keeping the temperature for 70 minutes. The pulp of the rice straw materials was obtained.

Embodiment 4

1) Preparing material:

The reed materials were processed by conventional dry or wet method to obtain a chopped grass.

2) Pre-cooking:

(1) The chopped reed with a temperature of 80° C. was conveyed into a T-shaped tube after being extruded by a screw feeder, the ammonium sulfite cooking liquor with a room temperature, a hot black liquor and steam were added from a top of the T-shaped tube and mixed with the chopped grass in T-shaped tube to obtain a forage with a temperature of 90° C. Wherein the amount of cooking liquor is 24% of the weight of bone dry grass raw materials, and the liquid ratio was 1:3.0.

(2) The forage entered into a horizontal tube, and steam flowed in the horizontal tube for the bottom to heat the forage up to 160° C. and keep in the horizontal tube for 12 minutes. And then the forage entered into the spherical mixer.

(3) The cooking liquor at 155° C. which was extruded by a dehydration spiral and the hot black liquor at 165° C. were added into the spherical mixer, mixed uniformly with the forage into the spherical mixer. The mixed concentration was 4%, the mixed temperature was 150° C. The mixture stayed in the spherical mixer for 2 minutes to complete pre-cooking.

3) Cooking:

The forage after pre-cooking process was conveyed to a digester. Firstly, the forage was dehydrated in the dehydration spiral which is arranged on the top of the digester to a dry degree of 11%. A top pressure of the digester is controlled in 7 bar. The cooking liquor was pumped out from the digester by a circulating pump, and the liquid ratio was adjusted to 1:8.5. The pumped cooking liquor was heated by a heater outside the digester and was transported back into the digester for heating the forage up to 170° C. and keeping the temperature for 100 minutes. The pulp of the reed materials is obtained.

The pulp of the grass raw materials has a hardness of potassium permanganate 20K.

Embodiment 5

1) Preparing material:

The wheat straw materials were processed by conventional dry or wet method to obtain a chopped wheat straw.

2) Pre-cooking:

The chopped wheat straw was measured by a pin drum metering device before being conveyed into a T-shaped tube, and enters into a pre-cooking spiral. Steam was added into the pre-cooking spiral to soften the chopped wheat straw, in which a temperature was controlled at 40° C. The chopped wheat straw entered into the T-shaped tube after being extruded by a screw feeder. A moisture of the chopped grass in the T-shaped tube was 58%, and a temperature was 63° C. The sodium hydroxide cooking liquor with a temperature of 90° C. and steam were added from a top of the T-shaped tube and mixed with the chopped wheat straw in T-shaped tube to obtain a forage with a temperature of 88° C. Wherein the amount of the cooking liquor was 10% of the weight of bone dry grass raw materials, and the liquid ratio was 1:3.1.

(2) The forage entered into a horizontal tube from the bottom, and steam flows in the horizontal tube to heat the forage up to 135° C. and keep in the horizontal tube for 5.5 minutes, and then the forage entered into the spherical mixer.

(3) The cooking liquor at 152° C. which was extruded by a dehydration spiral and the hot black liquor at 150° C. were added into the spherical mixer, mixed uniformly with the forage in the spherical mixer. The mixed concentration was 3.5%, the mixed temperature was 148° C. The mixture stayed in the spherical mixer for 2.2 minutes to complete pre-cooking.

3) Cooking:

The forage after the pre-cooking process was conveyed to a digester. Firstly, the forage was dehydrated in the dehydration spiral which is arranged on the top of the digester to a dry degree of 11%. A top pressure of the digester was controlled in 5.5 bar. The cooking liquor was pumped out from the digester by a circulating pump, and the liquid ratio was adjusted to 1:9. The pumped cooking liquor was heated by a heater outside the digester and was transported back into the digester for heating the forage up to 155° C. and keeping the temperature for 60 minutes. The pulp of the wheat straw materials was obtained.

The pulp of the grass raw materials has a hardness of potassium permanganate 25K.

Embodiment 6

1) Preparing material:

The grass raw materials were processed by conventional dry or wet method to obtain a chopped grass.

2) Pre-cooking:

The chopped grass was measured by a pin drum metering device before being conveyed into a T-shaped tube, and enters a pre-cooking spiral. Steam was added into the pre-cooking spiral to soften the chopped grass, in which a temperature was controlled at 60° C. The chopped grass enters into the T-shaped tube after being extruded by a screw feeder. A moisture of the chopped grass in the T-shaped tube was 61%, a temperature was 81° C. The sodium hydroxide cooking liquor with a temperature of 95° C. was added from the top of the T-shaped tube and mixed with the chopped grass in T-shaped tube to obtain a forage with a temperature of 91° C. Wherein the amount of the cooking liquor was 16% of the weight of bone dry grass raw materials, and the liquid ratio was 1:2.9.

(2) The forage entered into a horizontal tube from the bottom, and steam flows in the horizontal tube to heat the forage up to 137° C. and keep in the horizontal tube for 5.2 minutes, and then the forage entered into the spherical mixer.

(3) The cooking liquor at 153° C. which was extruded by a dehydration spiral and the hot black liquor at 155° C. were added into the spherical mixer, mixed uniformly with the forage in the spherical mixer. The mixed concentration was 4.3%, the mixed temperature was 146° C. The mixture stayed in the spherical mixer for 2.7 minutes to complete pre-cooking.

3) Cooking (1) The forage after the pre-cooking process was conveyed to the dehydration spiral which is arranged on the top of the digester for dehydrating to a dry degree of 10%. An extruded cooking liquor flowed back into a buffer tank, and was pumped to the spherical mixer by a pump as part of the cooking liquor.

(2) A dehydrated forage was conveyed to a circular heating area of the digester. The cooking liquor was pumped out from the digester through a circulating pump, and the liquid ratio was adjusted to 1:9.2. The pumped cooking liquor was heated by a heater outside the digester and then was transported back to the digester far heating the forage in the circular beating area up to 160° C. Then the mixture of the forage and the cooking liquor entered into a concentrating area, and the liquid ratio was adjusted to 1:5.5 by pumping out some of the cooking liquor. The pumped cooking liquor flowed back to the buffer tank, and was transported to the spherical mixer by a pump as part of the cooking liquor. The mixture of the forage and the cooking liquor entered into a heat preservation area, and was kept for 80 minutes at 160° C. A coarse pulp and black liquor were obtained.

(3) The coarse pulp and black liquor entered into an adjusting concentration area. The black liquor was filtered out through a filter screen arranged in adjusting concentration area, entered into a concentrating tank, and then the black liquor is pumped to a hot black liquor tank by a concentrated pump and entered into the spherical mixer as supplementary black liquor. The black liquor was used for the cooking liquor together with the cooking liquor in the spherical mixer Which was pumped from the buffer tank. The black liquor with a temperature of 50° o entered into the digester through an intermediate pipe of the digester as the replacement liquid, mixed with the coarse pulp for replacement and concentration adjustment. The coarse pulp was adjusted to a concentration of 6% and a temperature of 90° 90 in the area, and proceeds cold blew through a discharger at the bottom of the digester. A pulp of the grass raw materials was obtained, and a heavy black liquor replaced was recycled at the same time.

The pulp of the grass raw materials has a hardness of potassium permanganate 22-24K.

Embodiment 7

1) Preparing material:

The grass raw materials were processed by conventional dry or wet method to obtain the chopped grass.

2), Pre-cooking:

The chopped grass was measured by a pin drum metering device before being conveyed into a T-shaped tube, and entered a pre-cooking spiral. Steam was added into the pre-cooking spiral to soften the chopped grass, in which a temperature was controlled at 48° C. The chopped grass enters into the T-shaped tube after being extruded by a screw feeder. A moisture of the chopped grass in the T-shaped tube was 61%, and a temperature was 77° C. The sodium hydroxide cooking liquor with a temperature of 90° C. and steam were added from the top of the T-shaped tube and mixed with the chopped grass in the T-shaped tube to obtain a forage with a temperature of 87° C. Wherein the amount of the cooking liquor was 14% of the weight of bone dry grass raw materials, and the liquid ratio was 1:3.2.

(2) The forage entered into a horizontal tube from the bottom, and steam flowed in the horizontal tube to heat the forage up to 139° C. and keep in the horizontal tube for 6 minutes, and then the forage entered into the spherical mixer.

(3) The cooking liquor at 151° C. which was extruded by a dehydration spiral and the hot black liquor at 164° C. were added into the spherical mixer, mixed uniformly with the forage in the spherical mixer. The mixed concentration was 4%, the mixed temperature was 149° C. The mixture stayed in the spherical mixer for 2.1 minutes to complete pre-cooking.

3) Cooking:

(1) The forage after the pre-cooking process is conveyed to the dehydration spiral which is arranged on the top of the digester for dehydrating to a dry degree of 12%. The extruded cooking liquor flows back into a buffer tank, and is pumped to the spherical mixer by a pump as part of the cooking liquor.

(2) A dehydrated forage was conveyed to a circular heating area of the digester. The cooking liquor was pumped out from the digester through a circulating pump, and the liquid ratio was adjusted to 1:7.8. The pumped cooking liquor was heated by a heater outside the digester and then was transported back to the digester for heating the forage in the circular heating area up to 164° C. Then the mixture of the forage and the cooking liquor entered into a concentrating area, and the liquid ratio was adjusted to 1:5 by pumping out sonic of the cooking liquor. The pumped cooking liquor flowed back to the buffer tank, and was transported to the spherical mixer by a pump as part of the cooking liquor. The mixture of the forage and the cooking liquor entered into a heat preservation area, and was kept for 120 minutes at 164° C. A coarse pulp and black liquor were obtained.

(3) The coarse pulp and black liquor entered into an adjusting concentration area. The black liquor are filtered out through a filter screen arranged in the adjusting concentration area, entered into a concentrating tank, and then the black liquor is pumped to a hot black liquor tank by a concentrated pump and entered to the spherical mixer as supplementary black liquor. The black liquor was used for the cooking liquor together with the cooking liquor in the spherical mixer which was pumped from the buffer tank. The black liquor with temperature of 70° T obtained from the extraction section entered into the digester through an intermediate pipe of the digester as the replacement liquid, mixed with the coarse pulp for replacement and concentration adjustment. The coarse pulp was adjusted to a concentration of 6% and a temperature of 90° 90 in this area, and proceeded cold blew through a discharger at the bottom of the digester. A pulp of the grass raw materials was obtained, and a heavy black liquor replaced was recycled at the same time.

The pulp of the grass raw materials has a hardness of potassium permanganate 20K.

Embodiment 8

1) Preparing material:

The grass raw materials were processed by conventional dry or wet method to obtain a chopped grass.

2) Pre-cooking:

The chopped grass was measured by a pin drum metering device before being conveyed into a T-shaped tube, and enters a pre-cooking spiral. Steam was added into the pre-cooking spiral to soften the chopped grass, in which a temperature was controlled at 4° C. The chopped grass entered into the T-shaped tube after being extruded by a screw feeder. A moisture of the chopped grass in T-shaped tube was 61%, and a temperature was 77° C. The ammonium sulfite cooking liquor with a room temperature, a hot black liquor and steam were added from the top of the T-shaped tube and mixed with the chopped grass in the T-shaped tube to obtain a forage with a temperature of 87° C. Wherein the amount of the cooking liquor was 25% of the weight of bone dry grass raw materials, and the liquid ratio was 1:3.2.

(2) The forage entered into a horizontal tube from the bottom, and steam flowed in the horizontal tube to heat the forage up to 157° C. and keep in the horizontal tube for 10 minutes, and then the forage entered into the spherical mixer.

(3) The cooking liquor at 155° C. which was extruded by a dehydration spiral and the hot black liquor at 165° C. were added into the spherical mixer, mixed uniformly with the forage in the spherical mixer. The mixed concentration was 4%, the mixed temperature was 159° C. The mixture stayed in the spherical mixer for 2.1 minutes to complete pre-cooking.

3) Cooking:

(1) The forage after the pre-cooking process was conveyed to the dehydration spiral which is arranged on the top of the digester for dehydrating to a dry degree of 12%. An extruded cooking liquor flowed back into a buffer tank, and was pumped to the spherical mixer by a pump as part of the cooking liquor.

(2) A dehydrated forage was conveyed to a circular heating area of the digester. The cooking liquor was pumped from the digester through a circulating pump, and the liquid ratio was adjusted to 1:7.8. The pumped cooking liquor was heated by a heater outside the digester, and then was transported back to the digester for heating the forage in the circular heating area up to 172° C. Then the mixture of the forage and the cooking liquor entered into a concentrating area, and the liquid ratio was adjusted to 1:6 by pumping out some of the cooking liquor. The pumped cooking liquor flowed back to the buffer tank, and was transported to the spherical mixer by a pump as part of the cooking liquor. The mixture of the forage and the cooking liquor entered into a heat preservation area; and was kept for 60 minutes at 172° C. A coarse pulp and black liquor were obtained.

(3) The coarse pulp and black liquor entered into an adjusting concentration area. The black liquor was filtered out through a filter screen arranged in the adjusting concentration area, entered into a concentrating tank, and then the black liquor was pumped to a hot black liquor tank by a concentrated pump and entered to the spherical mixer as supplementary black liquor. The black liquor was used for the cooking liquor together with the cooking liquor in the spherical mixer which was pumped from the buffer tank became the cooking liquor. The black liquor with a temperature of 60° C. obtained from the extraction section entered to the digester through an intermediate pipe of the digester as the replacement liquid, mixed with the coarse pulp for replacement and concentration adjustment. The coarse pulp was adjusted to a concentration of 8% and a temperature of 100° C. in this area, and proceeded cold blew throat a discharger at the bottom of the digester. A pulp of the grass raw materials was obtained, and a heavy black liquor was recycled at the same time.

The pulp of the grass raw materials has a hardness of potassium permanganate 26K.

Embodiment 9

A device for continuously cooking grass raw materials, includes a T-shaped tube. 4, a horizontal tube 5 and a digester 8, one end of the horizontal tube 5 is connected with the spherical mixer 6, and other end is connected with the T-shaped tube 4. A spherical mixer 6 is connected between the horizontal tube 5 and the digester 8.

The digester 8 comprises a circular heating area, a concentrating area, a heat preservation area and an adjusting concentration area, and a dehydration spiral 7 is arranged on the top of the digester 8.

A filter screen arranged in the circular heating area, in the concentrating area and in the adjusting concentration area respectively.

The spherical mixer 6 is connected with the digester 8 by a straw piece pump. The T-shaped tube 4 is connected in turn with a screw feeder 3, a pre-cooking spiral 2 and a pin drum metering device 1. An upper part and a middle part of the digester 8 are connected with a buffer tank 11 respectively, and a lower part of the digester 8 is connected with a concentrating tank 12. The buffer tank 11 is connected with the spherical mixer 6. The buffer tank 11 is connected with the spherical mixer 6 through a pump. A hot black liquor tank 10 is connected with the spherical mixer 6.

The working process of this device for continuously cooking grass raw materials is as following:

1) Preparing material:

The grass raw materials are processed by conventional dry or wet method to obtain a chopped grass.

2) Pre-cooking:

(1) The chopped grass is measured by the pin drum metering device 1 before being conveyed into the pre-cooking spiral 2. Steam is added into the pre-cooking spiral 2 at the same time to soften the chopped grass in the pre-cooking spiral 2. Then the softened chopped grass enters into the screw feeder 3, is extruded to form material plug, then the chopped grass enters into the T-shaped tube 4. The cooking liquor and steam are added from the top of the T-shaped tube 4, mixed with the chopped grass in the T-shaped tube 4 to obtain a forage.

(2) The forage enters into the horizontal tube 5, and steam flows the horizontal tube 5 from the bottom to heat evenly the forage, then the forage enters into the spherical mixer 6;

(3) The cooking liquor which is extruded by the dehydration spiral 7 is added to the spherical mixer 6, and mixed uniformly with the forage in the spherical mixer 6, thus meets with the basic requirement of conveying the forage after the pre-cooking process to the dehydration spiral 7 arranged on the top of the digester 8.

3) Cooking:

(1) The forage pre-cooking process is conveyed by straw piece pump to the dehydration spiral 7 which is arranged on the top of the digester 8 for dewatering, and enters into the circular heating area of the digester 8. At the same time, the extruded cooking liquor flows back into the buffer tank 11, and was transported to the spherical mixer (6) by a pump as part of the cooking liquor.

(2) The forage enters into the circular heating area. The cooking liquor i pumped from the digester by a circulating pump is heated by a heater 9 outside the digester 8, and then transported back to the digester 8 for heating the forage in the circular heating area. The heated forage and the cooking liquor enter into the concentrating area, and the liquor ratio is adjusted by pumping out some of the cooking liquor to the buffer tank, and then enters into the heat preservation area for staying warm. After the end of the insulation, a coarse pulp and black liquor are got.

(3) The obtained black liquor is filtered out through the filter screen at the adjusting concentration area, enters into the concentration tank 12. And then the black liquor is pumped to the hot black liquor tank 10 by a concentrated pump and enters to the spherical mixer 6 as supplementary black liquor. The black liquor is used for the cooking liquor together with the cooking liquor in spherical mixer 6 which is pumped from the buffer tank 11. The black liquor with low temperature obtained from the extraction section enters to the digester 8 through an intermediate pipe of the digester 8 as the replacement liquid, mixed with the coarse pulp for replacement and concentration adjustment. Then the coarse pulp proceeds cold blew through a discharger at the bottom of the digester 8. A pulp of the grass raw materials is obtained.

Test 1

The test case compares the production capacity, steam consumption, energy consumption, chemicals consumption of different pulping methods and the results shows in table 1 below:

TABLE 1

| No | Content | Method in present invention | Traditional continuously cooking with horizontal tube | Method for continuously cooking in CN101906729A |
|---|---|---|---|---|
| 1 | Production capacity (t pulp/day) | 450 | 145 | 300 |
| 2 | Steam consumption (t steam/t pulp) | 3.0 | 3.6 | 2.8 |
| 3 | Energy consumption (kW · h/t pulp) | 500 | 460 | 480 |
| 4 | Chemicals consumption(%) (according to the weight of ammonium sulfite) | 22 | 18 | 20 |
| 5 | Hardness of Pulp after cooking $KMnO_4$ | 20 | 14 | 20 |

The invention claimed is:

1. A method for continuously cooking grass raw materials comprising:

(1) preparing material:

preparing grass raw materials by conventional dry or wet method to obtain a chopped grass;

(2) pre-cooking:

1) conveying the chopped grass into a T-shaped tube after being extruded by a screw feeder, adding a cooking liquor and steam from a top of the T-shaped tube and mixing with the chopped grass in the T-shaped tube to obtain a forage;

2) adding steam into a horizontal tube from a bottom of the horizontal tub after the forage being into the horizontal tube, the forage being heated and going into a spherical mixer;

3) adding a cooking liquor extruded by a dehydration spiral into the spherical mixer, mixing uniformly with the forage in the spherical mixer, completing a pre-cooking process;

(3) cooking:

conveying the forage after the pre-cooking process to a digester, heating the cooking liquor by a heater arranged outside the digester, and sending the cooking liquor back to the digester for cooking the forage to obtain a pulp of the grass raw materials.

2. A method for continuously cooking grass raw materials according to claim 1, wherein, cooking comprises:

conveying the forage after the pre-cooking process to the digester, pumping the cooking liquor from the digester by a circulating pump and adjusting a liquid ratio to a range from 1:7 to 1:10, heating the cooking liquor pumped from the digester by the heater arranged outside the digester, sending the cooking liquor after heating back to the digester to heat the forage to a temperature from 150° C. to 175° C., and keeping the temperature for 40-120 minutes, and obtaining the pulp of the grass raw materials.

3. A method for continuously cooking grass raw materials according to claim 2, wherein, cooking comprises four stages: circular heating stage, concentrating stage, heat preservation stage and adjusting concentration stage, wherein, in the circular heating stage, the cooking liquor is pumped from the digester by the circulating pump and adjusting the liquid ratio to a range from 1:7 to 1:10, and the cooking liquor pumped is heated by the heater arranged outside the digester and sent back to the digester for heating the forage to a temperature from 150° C. to 175° C.;

in the concentrating stage, the liquid ratio is adjusted to a range from 1:5.5 to 1:6.5 by pumping out some cooking liquor.

4. A method for continuously cooking grass raw materials according to claim 3, wherein, in step 1) of the pre-cooking process, the chopped grass is measured by a pin drum metering device before being conveyed into the T-shaped tube, and enters into a pre-cooking spiral, steam is added into the pro-cooking spiral to soften the chopped grass, in which a temperature is controlled in a range from 40° C. to 60° C., then the chopped grass enters into the T-shaped tube after being extruded by the screw feeder, a moisture of the chopped grass into the T-shaped tube is in a range from 55% to 65%, and a temperature is in a range from 75° C. to 85° C.

5. A method for continuously cooking grass raw materials according to claim 3, wherein, in cooking process, the forage after the pre-cooking process is conveyed to the digester, first, a dehydration processing is done by the dehydration spiral disposed on a top of the digester until a dry degree in a range from 10% to 12, and a top pressure of the digester is controlled in a range from 5 to 8 bar.

6. A method for continuously cooking grass raw materials according to claim 2, wherein, in step 1) of the pre-cooking process, a amount of the cooking liquor in the T-shaped tube is in a range from 20% to 26% of a weight of bone dry grass raw materials in an ammonium cooking method, or is in a range from 10% to 16% in a sodium hydroxide cooking method, and the liquid ratio is in a range from 1:2.8 to 1:3.3.

7. A method for continuously cooking grass raw materials according to claim 6, wherein, in step 2) of the pre-cooking process, the forage is heated up to a temperature from 130° C. to 165° C., and a duration time of the forage in the horizontal tube is in a range from 5 min to 12 min.

8. A method for continuously cooking grass raw materials according to claim 2, wherein, In step 1) of the pre-cooking process, the chopped grass is measured by a pin drum metering device before being conveyed into the T-shaped tube, and enters into a pre-cooking spiral, steam is added into the pre-cooking spiral to soften the chopped grass, in which a temperature is controlled in a range from 40° C. to 60° C., then the chopped grass enters into the T-shaped tube after being extruded by the screw feeder, a moisture of the chopped grass into the T-shaped tube is in a range from 55% to 65%, and a temperature is in a range from 75° C. to 85° C.

9. A method for continuously cooking grass raw materials according to claim 2, wherein, in cooking process, the forage after the pre-cooking process is conveyed to the digester, first, a dehydration processing is done by the dehydration spiral disposed on a top of the digester until a dry degree in a range from 10% to 12%, and a top pressure of the digester is controlled in a range from 5 to 8 bar.

10. A method for continuously cooking grass raw materials according to claim 1, wherein, in step 1) of the pre-cooking process, a amount of the cooking liquor in the T-shaped tube is in a range from 20% to 26% of a weight of bone dry grass raw materials in an ammonium cooking method, or is in a range from 10% to 16% in a sodium hydroxide cooking method, and the liquid ratio is in a range from 1:2.8 to 1:33.

11. A method for continuously cooking grass raw materials according to claim 10, wherein, in step 2) of the pre-cooking process, the forage is heated up to a temperature from 130° C. to 166° C., and a duration time of the forage in the horizontal tube is in a range from 5 min to 12 min.

12. A method for continuously cooking grass raw materials according to claim 11, wherein, in step 3) of the pre-cooking process, the cooking liquor with a temperature between 145° C. and 155° C. is extruded by the dehydration spiral, the cooking liquor is mixed with the forage, a mixing concentration with a range from 3% to 5% and a temperature is in a range from 145° C. to 155° C. after mixing, and a duration time in the spherical mixer is in a range from 1.5 min to 3 min.

13. A method for continuously cooking grass raw materials according to of claim 1, wherein, in step 1) of the pre-cooking process, the chopped grass is measured by a pin drum metering device before being conveyed into the T-shaped tube, and enters into a pre-cooking spiral, steam is added into the pre-cooking spiral to soften the chopped grass, in which a temperature is controlled in a range from 40° C. to 60° C., then the chopped grass enters into the T-shaped tube after being extruded by the screw feeder, a moisture of the chopped grass into the T-shaped tube is in a range from 55% to 65%, and a temperature is in a range from 75° C. to 85° C.

14. A method for continuously cooking grass raw materials according to claim 1, wherein, in cooking process, the forage after the pre-cooking process is conveyed to the digester, first, a dehydration processing is done by the dehydration spiral disposed on a top of the digester until a dry degree in a range from 10% to 12%, and a top pressure of the digester is controlled in a range from 5 to 8 bar.

* * * * *